US005664941A

United States Patent [19]

Bearint

[11] Patent Number: 5,664,941

[45] Date of Patent: Sep. 9, 1997

[54] BEARINGS FOR A ROTARY VANE COMPRESSOR

[75] Inventor: David E. Bearint, Decatur, Ill.

[73] Assignee: Zexel USA Corporation, Decatur, Ill.

[21] Appl. No.: 577,730

[22] Filed: Dec. 22, 1995

[51] Int. Cl.[6] ..... F04C 18/344; F04C 29/00

[52] U.S. Cl. ..... 418/259; 418/270

[58] Field of Search ..... 418/107, 259, 418/270; 384/539, 540, 903; 415/229

[56] References Cited

U.S. PATENT DOCUMENTS

| | | | |
|---|---|---|---|
| 2,243,901 | 6/1941 | Fulcher | 418/107 |
| 2,476,586 | 7/1949 | Darash | 384/539 |
| 2,552,860 | 5/1951 | Oliver . | |
| 2,739,446 | 3/1956 | Godsil . | |
| 2,763,217 | 9/1956 | Klessig et al. . | |
| 2,904,012 | 9/1959 | Hazen . | |
| 3,071,228 | 1/1963 | Zeidler et al. | 384/539 |
| 3,072,320 | 1/1963 | Cox et al. . | |
| 3,295,752 | 1/1967 | Bellmer et al. . | |
| 3,439,623 | 4/1969 | Dietrick et al. . | |
| 3,804,562 | 4/1974 | Hansson | 418/259 |
| 3,865,515 | 2/1975 | Allen | 418/107 |
| 3,988,080 | 10/1976 | Takada | 418/76 |
| 4,498,853 | 2/1985 | Sakamaki et al. | 418/268 |
| 4,501,537 | 2/1985 | Ishizuka | 418/259 |
| 4,505,649 | 3/1985 | Masuda et al. | 418/259 |
| 4,747,755 | 5/1988 | Ohtsuki et al. | 417/282 |
| 4,758,137 | 7/1988 | Kieper . | |
| 4,854,751 | 8/1989 | Grassmuck et al. | 384/903 |
| 5,051,070 | 9/1991 | Kazaoka et al. | 417/295 |
| 5,240,388 | 8/1993 | Matsumoto et al. | 417/299 |
| 5,322,427 | 6/1994 | Hsin-Tau | 418/83 |

FOREIGN PATENT DOCUMENTS

| | | | |
|---|---|---|---|
| 871050 | 1/1942 | France | 418/270 |

*Primary Examiner*—John J. Vrablik
*Attorney, Agent, or Firm*—James E. Bradley

[57] ABSTRACT

A rotary vane compressor has a compressor housing which contains an oval chamber. A cylindrical rotor is mounted on an axial shaft and has radial vanes which engage the chamber and slide radially inward and outward in slots formed in the rotor as the shaft rotates. A pair of thrust shoulders are on the shaft, spaced axially apart from each other exterior of the rotor and facing in axially opposite directions. A deep groove ball bearing assembly is stationarily mounted in the housing in engagement with both of the shoulders on the shaft. Radial, moment, and thrust in both axial directions applied to the shaft are transferred by the shoulders through the bearing assembly to the compressor housing.

13 Claims, 2 Drawing Sheets

BEARINGS FOR A ROTARY VANE COMPRESSOR

BACKGROUND OF THE INVENTION

1. Field of the Invention

This invention relates in general to rotary vane compressors for air conditioning systems, particularly for vehicles.

2. Description of the Prior Art

A rotary vane automotive air conditioning compressor has a compressor housing that contains a chamber with front and rear side blocks, and a cylindrical rotor that rotates on a shaft supported by bearings within the chamber. The rotor has vanes mounted to it which slide outward and inward within slots formed in the rotor. The vanes slide against the wall of an oval chamber. Refrigerant at suction pressure enters the compression chamber. The vanes compress the refrigerant before it is discharged through a valve.

In the prior art, sliding vane rotary compressors made use of the interfaces between the rotor and the front and rear side blocks to resist axial thrust loads created by electromagnetic clutches and internal pressure. This traditional and costly design approach places severe specification requirements on the rotor/shaft assembly, the supporting radial bearings, and the two side blocks. Machining for flatness, perpendicularity, runout, and surface finish are all done to extremely small tolerances. Surface treatments to prevent the rotor from galling the side blocks must be carefully controlled during all phases of the process. To provide lubrication to the rotor/side block interfaces, small holes are drilled in the side blocks. Hot, oil-ladened discharge gas is metered to the interfaces through the small holes. Producing acceptable parts for this type of compressor is very costly and scrap rates are not insignificant.

Bearings which will support a shaft against axial thrust loads have been employed in general in industry. One type of such bearing employs two ball bearings, with the outer races engaging each other and the inner races spaced apart from each other and preloaded through the balls and outer races against the shaft. Such bearings have not been employed in refrigerant compressors to applicant's knowledge. Rather, only radial support bearings have been used, with the thrust being handled through the interfaces between the rotor and side blocks.

SUMMARY OF THE INVENTION

In this invention, the rotor shaft is fitted with a bearing pack that resists thrust loads, thereby relieving the rotor and side blocks of that responsibility. The bearing pack assumes all radial, thrust and moment loads. The sides of the rotor are spaced from the side blocks, maintaining clearances under all operating conditions.

The rotor shaft is cantilevered and supported by two deep groove ball bearings. The inner races of the ball bearings are axially preloaded against the shaft. Preloading results in an extremely rigid bearing support for both radial and thrust loads while maintaining near zero mechanical lash or free play.

DETAILED DESCRIPTION OF THE INVENTION

Figure 1:
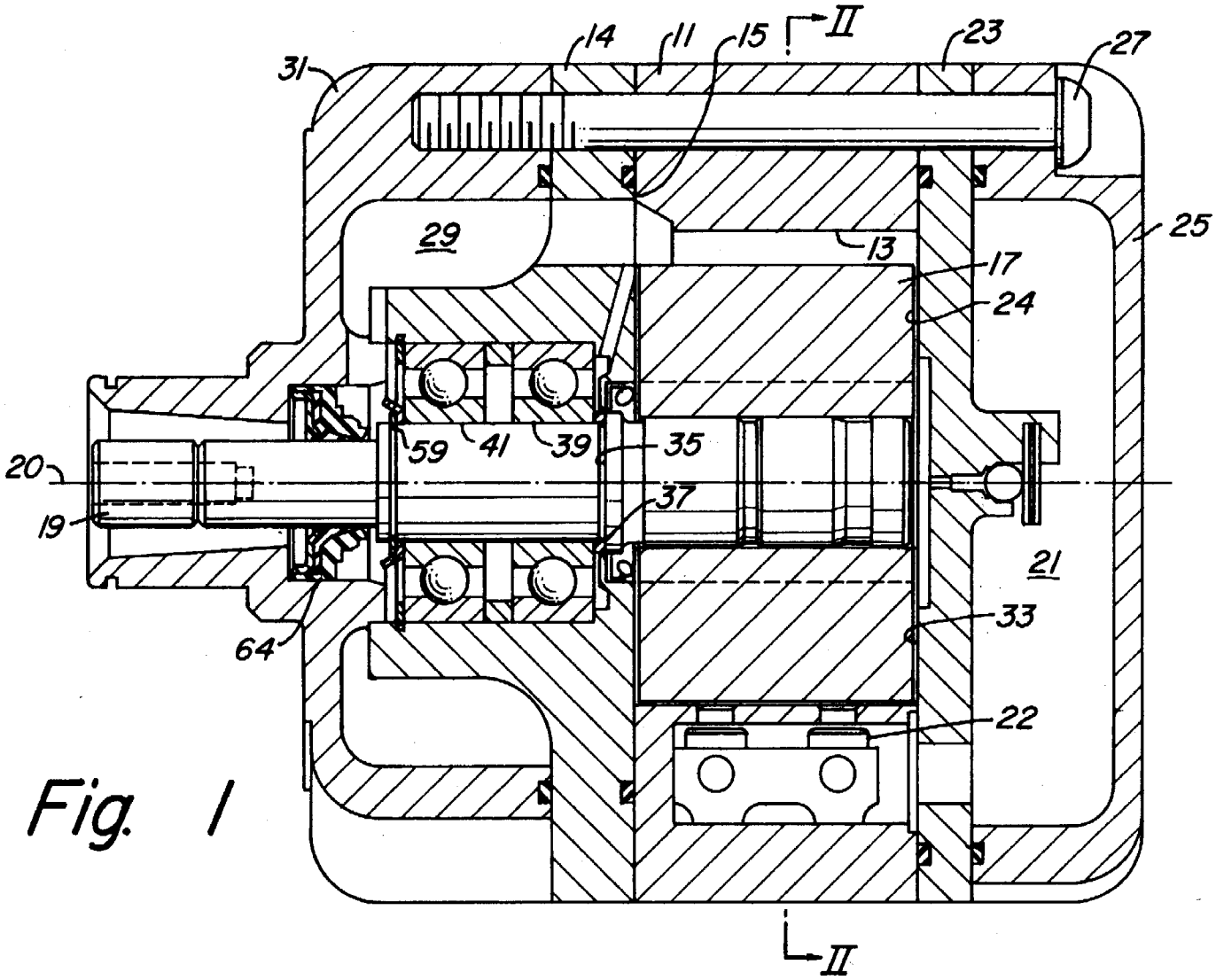
FIG. 1 is a sectional view illustrating a compressor constructed in accordance with this invention.
Figure 2:
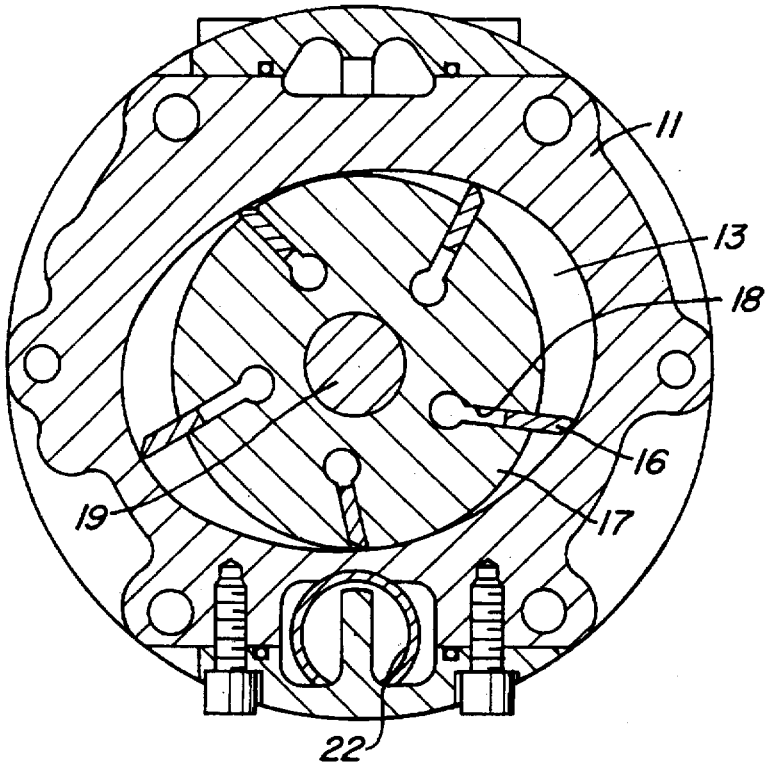
FIG. 2 is a sectional view of the compressor of FIG. 1, taken along the line II—II of FIG. 1.

Referring to FIG. 1, the compressor has a compression housing 11. Compression housing 11 has a compression chamber 13 which extends axially and which is oval in configuration as shown in FIG. 2. A front side block 14 is mounted to the forward side of compression housing 11. Front side block 14 has a wall or shoulder 15 which abuts compression chamber 13 and which faces in a rearward direction, with "rearward" being an arbitrary reference which is to the right in FIG. 1.

A rotor 17 having a plurality of vanes 16 (FIG. 2) and a cylindrical configuration is rotated within compression chamber 13 on a shaft 19 which has a rotational axis 20. Rotor 17 is rigidly mounted on shaft 19. Shaft 19 is connected to a drive source (not shown). Vanes 16 move radially inward and outward from slots 18 within rotor 17. Vanes 16 engage the sidewall of compression chamber 13 to compress refrigerant working fluid as rotor 17 rotates. A discharge valve 22 allows the discharge of refrigerant from compression chamber 13 into a discharge chamber 21.

A rear side block 23 abuts the rearward side of compression housing 11. Rear side block 23 has a forward facing shoulder 24 which serves as the rearward end of compression chamber 13. A rear head 25 is secured to the opposite side of rear side block 23. Bolts 27 secure rear head 25, rear side block 23, compression housing 11 and front side block 14 to a front head 31. Discharge chamber 21 is located within rear head 25. An intake or suction chamber 29 is located within front head 31. The compressor housing is made up of front head 31, front side block 14, compressor block 11, rear side block 23, and rear head 25.

The axial dimension of rotor 17, including its vanes 16, is only slightly less than the axial distance between shoulders 15 and 24, which is also the axial dimension of chamber 13. This results in an extremently small clearance 33 on each side of rotor 17 and vanes 16 between the shoulders 15 and 24. To minimize leakage of compressed refrigerant working fluid, clearance 33 is preferably the same as the clearance which existed in the prior art compressors. However, in the prior art compressor, the rotor is allowed to contact the side blocks to transfer thrust imposed on the rotor and shaft assembly. In this invention, under all operating conditions, rotor 17 will not come into contact with either shoulder 15 or 24, even though the clearance 33 is extremely small.

A thrust shoulder 35 is formed on shaft 19 within front side block 14. Thrust shoulder 35 faces in a forward direction and in the embodiment shown includes an adjustment ring 37 located on its forward side. Adjustment ring 37 is sized during assembly to provide the precise clearances 33. If due to machining tolerances, clearance 33 is not within the desired range, a different adjustment ring 37 will be used, one with a different axial cross-sectional thickness. A first deep groove ball bearing 39 fits on shaft 19 and abuts the adjustment ring 37 that bears against thrust shoulder 35. A second deep groove ball bearing 41 fits on shaft 19 forward of and in abutment with bearing 39. The bearing pack made up of bearings 39 and 41 supports shaft 19 radially in a cantilevered manner as well as resisting thrust in both forward and rearward directions.

Figure 3:
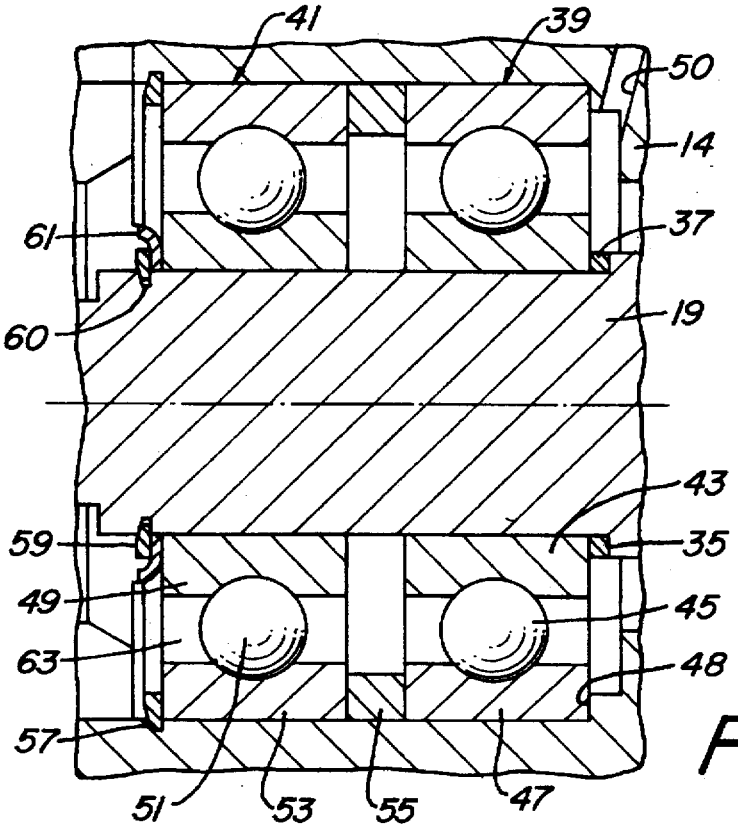
FIG. 3 is an enlarged partial sectional view of a portion of the compressor of FIG. 1.

Referring to FIG. 3, bearing 39 has an inner race 43, a plurality of balls 45, and an outer race 47. Outer race 47 engages a shoulder 48 in front side block 14. A lubrication passage 50 leads through front side block 14 approximately at shoulder 48 to compression chamber 13. Bearing 41 has an inner race 49, a plurality of balls 51, and an outer race 53.

A spacer ring 55 is located between the outer races 47, 53 to serve as an abutment means for transferring axial load from one outer race to the other. Inner races 43, 49 are axially spaced apart from each other. An outer retainer or snap ring 57 is located in a groove in front side block 14 to snuggly retain outer races 47, 53. Snap ring 57 is preferably wedged shaped to create a snug fit. Snap ring 57 applies an axial preload force against the outer races 47, 53. The outer races 47, 53 thus are stationarily or rigidly mounted in front side block 14. A preload snap ring 59 is secured in a groove 60 on the forward side of bearing 41. Snap ring 59 is a split ring which has a tapered or wedge-shaped cross-section. A tabbed washer 61 locates between snap ring 59 and inner race 49 and is bent over snap ring 59. A main shaft seal 64 rotatably seals shaft 19 to a shaft opening in front head 31.

To assemble the compressor, shaft 19 with rotor 17 affixed, is slidably inserted from right to left in the bores of the inner races of bearings 39, 41. When fully inserted and loaded from right to left within front side block 14 and compession housing 11, a clearance measurement is made between the rear face of rotor 17 and the rear face of compression housing 11. If necessary, shaft 19 with rotor 17 is withdrawn and a thinner or thicker adjustment ring 37 is fitted so that proper rotor clearance 33 will be achieved between shoulders 15, 24.

Referring to FIG. 3, once the proper clearance 33 has been achieved, snap ring 59 is then fitted to abut washer 61 and engage groove 60. The action of snap ring 59 pushes shaft 19 from right to left, loading inner race 43 against balls 45, and in turn outer race 47 through path 62. At the same time, snap ring 59 applies an axial load from left to right at inner race 49, transferring that load to balls 51 and outer race 53 through path 63. The deep groove ball bearings 39, 41 are now axially loaded against one another. This arrangement takes up all mechanical lash or clearances in the bearings 39, 41, and provides a bearing pack that is extremely rigid to radial, moment, and axial loads in all directions. Tabbed washer 61 prevents snap ring 59 from expanding under centrifugal loading at high shaft rotating speeds.

In operation, shaft 19 is driven, causing rotor 17 to rotate within chamber 13. Refrigerant working fluid is drawn into intake chamber 29 from the evaporator side of a refrigerant system, where it flows through a passage into compression chamber 13. Some of the refrigerant flows through bearings 39, 41 and through passage 50 for lubricating the bearings and main shaft seal 64. As shown in FIG. 2, vanes 16 compress the refrigerant, which passes through valve 22 to discharge chamber 21. Radial, moment and thrust loads are applied to shaft 19 due to compression of the refrigerant. Typically at startup, a thrust load acts in the rearward direction due to clutch engagement, although under operating conditions, thrust also acts in the forward direction. The forward acting thrust applies a force to thrust shoulder 35, which as shown in FIG. 3, is transmitted along a path through inner race 43, balls 45, outer race 47, spacer 55, and outer race 53 to outer retainer ring 57 and front side block 14. In the case of rearward acting thrust, snap ring 59 acts as a thrust shoulder. Force acting on snap ring 59 acts along a path through inner race 49, balls 51, outer race 53, spacer 55, and outer race 47 to shoulder 48 of front side block 14. In both cases, clearances 33 remain between rotor 17 and shoulders 15, 24.

This invention has significant advantages including lower costs for parts, labor and manufacturing. Suitable deep groove ball bearings are relatively inexpensive and readily available.

While the invention has been shown in only one of its forms, it should be apparent to those skilled in the art that it is not so limited. The invention is susceptible to various changes without departing from the scope of the invention.

I claim:

1. In a compressor having a compressor housing which contains a chamber, a rotor mounted on an axial shaft for rotation within the chamber to compress refrigerant, the improvement comprising:

a pair of thrust shoulders on the shaft, spaced axially apart from each other exterior of the rotor and facing in axially opposite directions, with each shoulder being axially movable with the shaft;

a bearing assembly comprising two axially-spaced ball bearings, each having an inner race that is in engagement with one of the shoulders, an outer race stationarily mounted via means within the housing, and a plurality of balls located between, the inner races having an axial clearance therebetween and being free of contact with each other so that thrust in one axial direction passes through the inner race, balls, and outer race of one of the ball bearings to the outer race of the other ball bearing and then to the housing, and thrust in the opposite axial direction passes through the inner race, balls, and outer race of the other of the ball bearings to the outer race of said one of the ball bearings and then to the housing; and a spacer between the outer races for causing axial forces in both directions on the outer races to transmit directly to one another.

2. The compressor according to claim 1, wherein the bearing assembly is located entirely on one side of the rotor.

3. The compressor according to claim 1, wherein the outer races are preloaded against the housing.

4. The compressor according to claim 1 wherein one of the shoulders comprises a retainer ring secured within a groove on the shaft.

5. The compressor according to claim 1 wherein the shaft is cantilever supported by the bearing assembly.

6. In a compressor having a compressor housing which includes a front side block containing an intake chamber, a rear side block containing a discharge chamber, a cylindrical rotor mounted within an oval compression chamber in the compressor housing on an axial shaft, a plurality of radial vanes which slide radially in slots formed in the rotor to engage the compression chamber as the shaft rotates, the improvement comprising:

a first thrust shoulder on the shaft and facing forward;

a second thrust shoulder on the shaft and facing rearward, with each shoulder being axially movable with the shaft;

a first bearing stationarily mounted in the housing with an inner race in engagement with the first thrust shoulder, an outer race stationarily mounted via means within the housing, and a plurality of balls located between the races;

a second bearing stationarily mounted in the housing with an inner race in engagement with the second thrust shoulder, an outer race stationarily mounted via means within the housing, and a plurality of balls located between, the outer races transmitting axial forces with one another, the inner races having an axial clearance there between and being free of contact with each other so that thrust in one axial direction passes through the inner race, balls, and outer race of the first bearing to the outer race of the second bearing and then to the housing, and thrust in the opposite axial direction passes through the inner race, balls, and outer race of the second bearing to the outer race of the first bearing and then to the housing;

a spacer between the outer races for causing axial forces in both directions on the outer races to transmit directly to one another; and the rotor having an axial dimension that is less than an axial dimension of the compression chamber by an amount sufficient to prevent any thrust in either direction on the shaft from transmitting through the rotor to one of the side blocks.

7. The compressor according to claim 6 wherein both of the bearings are located in the front side block.

8. The compressor according to claim 6 wherein:

the thrust shoulders are located in the front side block and face each other; and the outer races are preloaded against the housing.

9. The compressor according to claim 6 wherein the shaft is cantilever supported by the bearings.

10. A rotary vane compressor comprising in combination:

an oval compression chamber;

a front side block on a front side of the compression chamber and containing an intake chamber;

a rear side block on a rear side of the compression chamber and containing a discharge chamber;

a cylindrical rotor mounted within the compression chamber on an axial shaft;

a plurality of radial vanes which slide radially in slots formed in the rotor to engage the compression chamber as the shaft rotates;

a first thrust shoulder on a portion of and axially movable with the shaft in the front side block and facing forward;

a first bearing having an inner race in engagement with the first thrust shoulder, an outer race in engagement with the front side block, and a set of balls located between the inner and outer races;

a second thrust shoulder on a portion of and axially movable with the shaft in the front side block and facing rearward;

a second bearing having an inner race in engagement with the second thrust shoulder and axially spaced from the other inner race such that the inner races are free of contact with each other, an outer race in engagement with the front side block, and a set of balls located between the inner and outer races of the second bearing, so that thrust in one axial direction passes through the inner race, balls, and outer race of the first bearing to the outer race of the second bearing and then to the housing, and thrust in the opposite axial direction passes through the inner race, balls, and outer race of the second bearing to the outer race of the first bearing and then to the housing;

abutment means between the outer races for causing axial forces in both directions on the outer races to transmit directly to one another;

preload means for applying a preload force in a rearward direction to the inner race of the second bearing, which transmits to the thrust shoulder via the balls and outer race of the second bearing and the outer race, balls and inner race of the first bearing; and the rotor having an axial dimension that is less than an axial dimension of the compression chamber by an amount sufficient to prevent any thrust in either direction on the shaft from transmitting through the rotor to one of the side blocks, so that thrust in both directions on the shaft transmits through the bearings to the housing.

11. The compressor according to claim 10 wherein the abutment means comprises a spacer located between the outer races of the first and second bearings.

12. The compressor according to claim 10 wherein the preload means comprises:

a groove formed in the shaft; and a retainer ring having a tapered cross-section which locates in the groove and bears against the inner race of the second bearing.

13. The compressor according to claim 10 wherein the shaft is radially supported in a cantilever manner by the bearings.

* * * * *